United States Patent [19]

Dorer

[11] 3,998,453

[45] Dec. 21, 1976

[54] SHEET CONVEYOR APPARATUS

[75] Inventor: Wilfried Dorer, Rebberg, Germany

[73] Assignee: Mathias Bauerle, GmbH, St. Georgen, Black Forest, Germany

[22] Filed: May 19, 1975

[21] Appl. No.: 578,499

[30] Foreign Application Priority Data

Jan. 15, 1975 Germany ..... 2501378

[52] U.S. Cl. ..... 271/272; 271/173; 198/624; 226/171

[51] Int. Cl.[2] ..... B65H 29/16

[58] Field of Search ..... 271/64, 80, 173, 198, 271/272–275, 34, 35, 3.14; 198/167; 226/171

[56] References Cited

UNITED STATES PATENTS

| | | | |
|---|---|---|---|
| 2,630,618 | 3/1953 | Sewell | 226/171 |
| 3,152,701 | 10/1964 | Weiland | 271/3.1 UX |
| 3,360,260 | 12/1967 | Rapparlie et al. | 198/167 |
| 3,860,232 | 1/1975 | Martin | 271/64 |
| 3,893,662 | 7/1925 | Boyd | 271/273 |

*Primary Examiner*—Robert W. Saifer
*Attorney, Agent, or Firm*—Finnegan, Henderson, Farabow & Garrett

[57] ABSTRACT

A conveyor apparatus for transporting sheets in a longitudinal direction along a transport path comprises a plurality of guide rollers arranged in axially spaced parallel relation and extending transverse to the direction of sheet transport. An endless belt means is provided having a lower run thereof coacting with the guide rollers to capture a sheet between the lower run of the belt and the guide rollers for advancing the sheet in a transport path. Selected ones of the guide rollers are positively driven and have their axes lying on an arc of slight curvature extending between axes of a first and a last guide roller with the arc curved upwardly towards the transport path. This arrangement provides a slight curvature to the lower run of the belt means to increase the frictional force exerted on the sheets for positive transport of the sheets in the transport path.

11 Claims, 3 Drawing Figures

SHEET CONVEYOR APPARATUS

CROSS-REFERENCE TO RELATED APPLICATION

The conveyor apparatus of this invention is adapted for use, for example, with a sheet distributing device as disclosed in copending U.S. application Ser. No. 554,821, filed Mar. 3, 1975, assigned to the same assignee as the present invention.

BACKGROUND OF THE INVENTION

The invention relates to an apparatus for distributing sheets in a predetermined sequence into a plurality of collection pockets arranged in a side-by-side row in a frame positioned beneath a horizontally moving belt extending over approximately the whole length of the frame.

The moving belt provides a sheet conveyor arrangement comprising one or more endless belts, a sheet deflecting device movable in a step-wise manner along the belt and at least two guide rollers tangent with a sheet transport path. At least one endless belt is guided on belt rollers and a lower run of the belt rides on the guide rollers and extends in the transport path. The sheet deflecting device includes at least one deflector roller movable between a raised position and a lowered position between the guide rollers for deforming the lower run of the belt into a U-shaped loop, or for acting directly against the sheet, for diverting the sheet from the transport path into a pocket, as fully disclosed in the above-identified application.

The foregoing device affords improved sheet transport at higher speeds and improved reliability of operation. With further reference to the above device, the guide rollers are arranged side-by-side in a horizontal plane such that the lower run of the endless belt in contact with the peripheries of the guide rollers provides only line contact with the guide rollers.

With extremely high conveyor speeds, positive transport of the sheets is not assured at all times since there is insufficient radial pressure between the belt and the guide rollers when the sheets pass therebetween. Therefore, the frictional force exerted against the sheets being transported is also insufficient or non-uniform.

SUMMARY OF THE INVENTION

The present invention provides for increasing the frictional force exerted against the sheets being transported such that at extremely high conveyor speeds positive control is maintained and transport of the sheets is assured.

The foregoing is attained by arranging selected ones of the guide rollers, spaced from each other at uniform intervals, with their axes located on a common arc extending between the axes of the two outer guide rollers and curved in a direction towards the transport path.

Since in a sheet distributing apparatus of the kind mentioned above it is not possible to provide pressing means such as, for example, conventional counter-pressure rolls or the like in the area above the transport path, because this area must necessarily be open to provide an unobstructed path for longitudinal movement of the sheet deflecting device, resort to the use of conventional means to solve the problem is precluded. Through the provisions of the present invention there is attained a much higher frictional force exerted on the sheet material being transported without the use of additional aids. This also provides for higher operating speeds without reducing the reliability of operation.

A further improvement is provided by locating certain of the guide rollers so that their axes lie on the chord connecting those guide rollers making direct contact with the belt. Thus, the lower run of the endless belt contacts the peripheries of the selected guide rollers lying on the arc not only in line contact or in a linear manner but, also, in a manner whereby the belt contacts a circumferential section of each of the selected guide rollers. This arrangement of providing a slight curvature by the selected guide rollers lying on the arc, and thus producing a slight curvature or arching of the lower run of the belt, provides surface contact between the lower run of the belt and the selected guide rollers.

Reliability of operation is further increased, as to positive sheet transport free of slippage and increase of operational speed, by positively driving the selected guide rollers lying on the arc in synchronism and at a speed corresponding with the speed of the belt, but independently of the belt.

To increase the curvature of the belt and thus the surface contact between the belt and the selected guide rollers, the invention further provides for those guide rollers not having their axes on the arc to be of smaller diameter than the selected guide rollers having their axes positioned on the arc. This provides a space between the peripheries of the smaller diameter guide rollers and the lower run of the belt corresponding approximately to the thickness of the maximum thickness sheet to be transported.

This space may also be obtained by providing all of the guide rollers with the same diameter and positioning those guide rollers not lying on the arc such that their axes lie in a plane providing a corresponding distance from the plane determined by the axes of the selected guide rollers arranged on the arc.

It is an object of the present invention to provide an improved sheet conveyor apparatus having a slightly curved sheet transport path to increase the frictional force exerted against the sheets being transported for providing positive control of the sheets traveling at high speed.

Another object of the invention is to provide a plurality of guide rollers coacting with a lower run of a driven endless belt, with selected ones of the guide rollers having their axes on a curved arc to provide peripheral surface contact of the selected guide rollers with the lower run of the belt. The other guide rollers are spaced slightly from the lower run of the belt to cause a slight curvature to the belt and provide a curved sheet transport path affording a substantial increase in the operational speed at which the sheets may be transported.

Another object of the invention is to provide a positive drive means for the selected guide rollers, operable independently of but in synchronism with the belt drive, to further improve sheet transport by preventing slippage between the selected guide rollers and the lower run of the belt.

Other features, objects and advantages of the invention will appear hereinafter as the description proceeds.

IN THE DRAWING

DESCRIPTION OF THE PREFERRED EMBODIMENT

Figure 1:
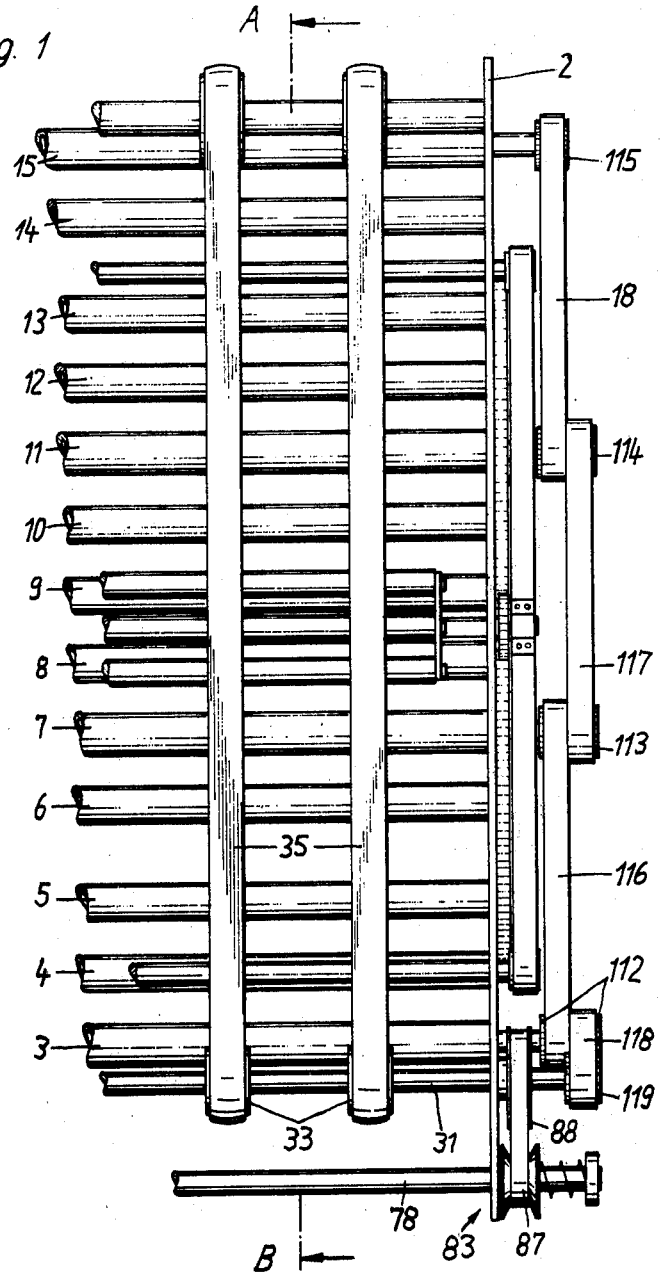
FIG. 1 is a plan view, partially broken away, showing a sheet conveyor in association with a sheet distributing device in accordance with the present invention.

For purposes of this disclosure the conveyor apparatus will be described as it might be incorporated, for example, in a sheet distributing device of the above-identified application. Accordingly, only a brief description of the sheet distributing device of the pending application will be given hereinafter. It will be appreciated that the structures in the drawing and their relationship have been exaggerated to illustrate the invention.

A plurality of guide rollers 3 – 15 are rotatably supported in a pair of side plates 1 and 2 mounted on transverse members 16 and 17 of a machine frame 18. The guide rollers 3 – 15 are arranged in a generally horizontal path above a plurality of sheet receiving pockets 19 – 25 and extend axially transverse to a direction of sheet transport.

Figure 2:
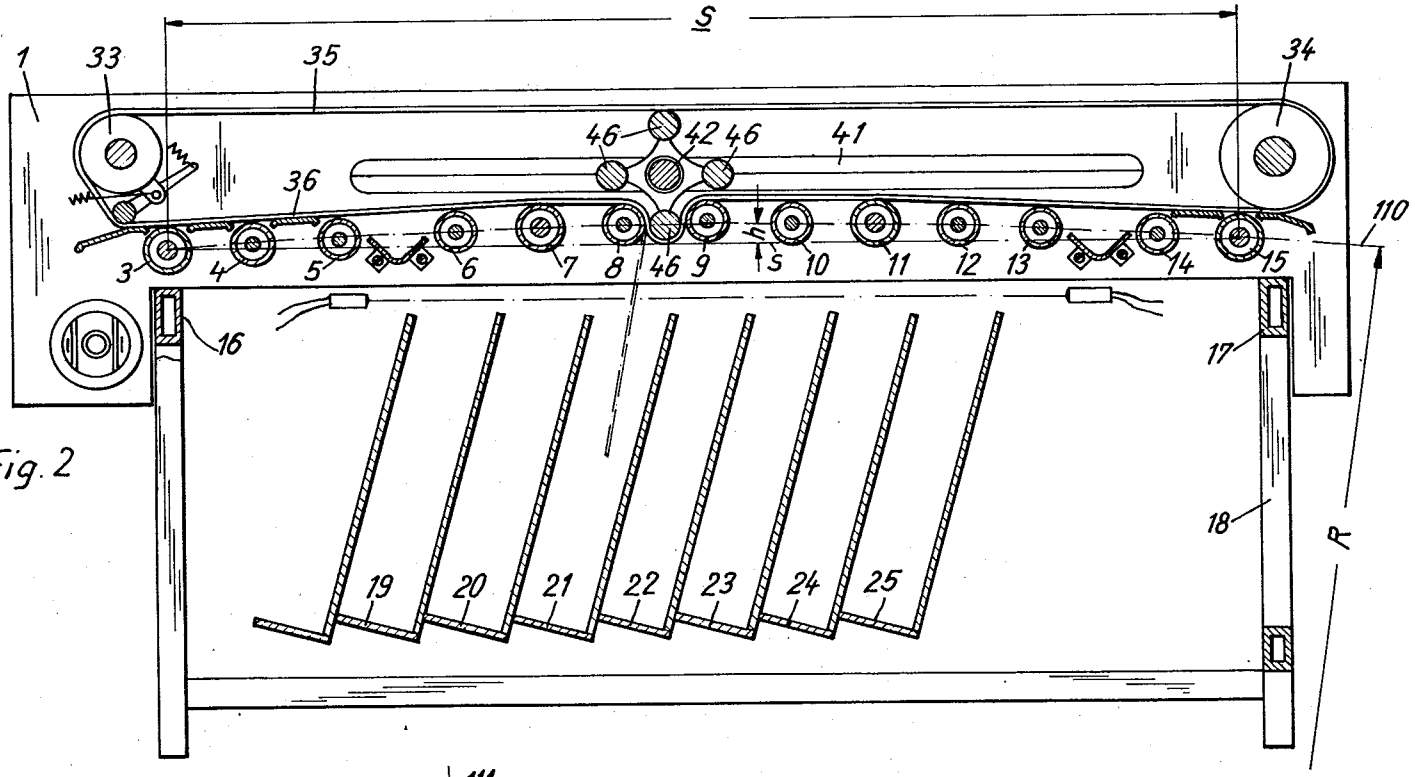
FIG. 2 is a section taken substantially along the plane of the line A-B of FIG. 1.
Figure 3:
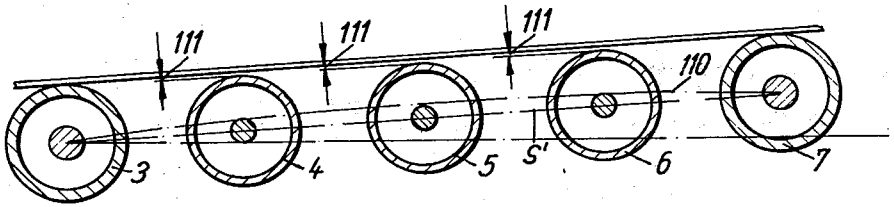
FIG. 3 is an enlarged section, partially broken away, illustrating guide rollers and selected guide rollers arranged in a curved transport path for exerting frictional force on sheets transported by the conveyor apparatus.

As best shown in FIGS. 2 and 3, selected ones of the guide rollers, namely, selected guide rollers 3, 7, 11 and 15 are supported with their axes on an arc 110, extending between the axes of a first and a last selected guide roller 3 and 15 respectively, in which a radius R of the arc 110 is calculated as follows:

$$R = h/2 + S^2/8h$$

where,

R = radius of the arc 110;

S = chord of the arc 110 (distance between the axes of the first and the last selected guide rollers 3 and 15);

$h$ = height of the circle segment formed between the chord S and the arc 110.

As shown in FIGS. 2 and 3, it will be seen that the arc 110 is curved slightly upwardly towards the sheet transport path. The guide rollers 4, 5 and 6 are positioned intermediate the neighboring selected guide rollers 3 and 7 and have their axes on a chord S′ extending between the axes of the selected guide rollers 3 and 7. Similarly, the guide rollers 8, 9 and 10 are positioned intermediate the selected guide rollers 7 and 11 which make contact with the belt and have their axes on a chord between the axes of the selected guide rollers 7 and 11, and the guide rollers 12, 13 and 14 are positioned with their axes on a chord between the axes of the neighboring selected guide rollers 11 and 15.

Referring now to FIG. 3, the diameters of the guide rollers 4, 5, 6 and 8, 9, 10 and 12, 13, 14 are smaller than the diameters of the selected or first set of guide rollers 3, 7, 11 and 15, thereby providing a space 111 between the peripheries of each of the guide rollers 4 – 6, 8 – 10 and 12 – 14 defining a second set of guide rollers and a lower run 36 of an endless belt means 35. Preferably, the space 111 corresponds to the thickness of the thickest sheet to be transported. However, this is not critical and a space 111 of about 1mm will suffice since the second set of guide rollers 4 – 6, 8 – 10 and 12 – 14 do not drive the sheets in transport, as do the first set of guide rollers 3, 7, 11 and 15, but are merely passively involved in the conveyance of the sheets in the transport path.

Through the provision of the space 111 and the arrangement of the selected guide rollers 3, 7, 11 and 15 on the arc 110 there is provided to the lower run 36 of the belt means 35, driven by drive rolls 33 and supported on idler rolls 34, a surface-type contact which affords considerably more frictional transport force to the sheets than can be obtained by line contact, as would be the case if the axes of all of the guide rollers of the first and the second sets were arranged on a horizontal plane rather than selected ones of the guide rollers having their axes positioned on an arc.

To further improve upon the high speed transport of the sheets, the present invention also provides for positive drive of the selected guide rollers 3, 7, 11 and 15. As shown in FIG. 1, each of the selected guide rollers 3, 7, 11 and 15 is provided with a pulley 112, 113, 114 and 115 respectively, driven by drive belts 116, 117 and 118.

The selected guide roller 3 is driven by a belt 118 associated with the pulley 112 and a pulley 119 secured on a shaft 31 supporting the drive rolls 33 of the belt means 35. Also, and as shown and described in the aforementioned copending application, the apparatus comprises a V-belt pulley 88 secured on the shaft 31 and driven by a belt 87. The belt 87 is driven by a variable speed means 83 supported on a shaft 78 powered by a motor not shown in the drawing.

As shown and described in the application referred to supra, and with reference to FIG. 2 of the present invention, the sheet distributing device includes a sheet deflector means comprising deflector rollers 46. The deflector rollers 46 are supported on turnstiles rotatably mounted on a shaft 42. The shaft 42 is guided in slide guides 41 provided in the side plates 1 and 2 and is adapted for movement in a path above and parallel with the transport path to permit the deflector rollers 46 to deflect the sheets from the transport path into selected pockets 19 – 25 as the turnstiles are rotated in their travel in the path. Thus, with the arrangement of the axes of the selected guide rollers 3, 7, 11 and 15 on the arc 110, and the axes of the intermediate guide rollers 4 – 6, 8 – 10 and 12 – 14 on the chords S′, there is no interference between the travel of the deflector means along the path and the radial curvature of the lower run 36 of the belt means 35 exerting frictional force to the sheets being conveyed along the transport path, as there would be if conventional counter-pressure rolls were utilized.

The height $h$ of the circle segment formed by the arc 110 and the chord S is adapted to predetermined measurement conditions, depending primarily on the radial distance between the deflector rollers 46. Advantageously, close tolerances need not be maintained in establishing the height $h$.

Because of the greatly increased frictional force exerted to the sheets in transport as provided by the present invention, the apparatus may be arranged such that the sheet transport is in a vertical or diagonal path with the sheet receiving pockets 19 – 25 repositioned accordingly. Thus, the apparatus is not limited to transporting sheets in only a specific directional transport path.

The complete operation of the sheet distributing apparatus, with which the conveyor apparatus of the present invention may be utilized as stated above, is shown and described in detail in the aforementioned copending application.

From the foregoing, it will be appreciated that the present invention provides a sheet conveyor which is simple in construction and reliable in operation. The arrangement of positioning the axes of selected guide rollers on an arc of slight curvature to exert frictional force to the sheets in transport affords positive control to the sheets for advancement at high speed in the transport path. Also, because the frictional force is applied from below the transport path, there are no obstacles in the transport path to hamper movement of the sheet deflector means described herein.

What is claimed is:

1. A sheet conveyor apparatus for transporting sheets in a longitudinal direction along a transport path, comprising:

a plurality of rotatable guide means positioned in axially spaced parallel relation and extending transverse to said direction of sheet transport;

belt means having a lower run thereof associated with the guide means for capturing sheets between the lower run of the belt means and a surface of the guide means defining said sheet transport path therebetween; and a first set of said guide means having their axes of rotation located on a common arc and their surfaces in contact with the lower run of the belt means, and a second set of said guide means intermediate the first set having their axes of rotation located a greater distance from the belt means than the first set whereby the surfaces of the second set of guide means are out of contact with the belt means.

2. An apparatus as set forth in claim 1 further comprising:

means for driving the belt means and the first set of guide means in synchronism.

3. An apparatus as set forth in claim 1 in which the guide means of the first set are arranged in pairs at axially spaced intervals in the transport path, and the guide means of the second set have their axes lying on a chord of the arc between each of the pairs of the first set of guide means.

4. An apparatus as set forth in claim 1 in which the surfaces of the guide means of the second set are spaced from the lower run of the belt means, and the surfaces of the guide means of the first set act against the lower run of the belt means to provide a slight curvature over a selected circumferential section of the lower run of the belt means.

5. An apparatus as set forth in claim 4 in which the space between the second set of guide means and the lower run of the belt means corresponds substantially to the average thickness of the thickest sheet to be transported.

6. An apparatus as set forth in claim 1 in which the second set of guide means comprises a second set of guide rollers and the first set of guide means comprises a first set of guide rollers, said second set of guide rollers having diameters smaller than the diameters of the first set of guide rollers.

7. A sheet conveyor apparatus for transporting sheets in a longitudinal direction along a transport path, comprising:

a plurality of guide rollers positioned in axially spaced parallel relation and extending transverse to said direction of sheet transport;

endless belt means having a lower run thereof associated with the guide rollers for capturing sheets between the lower run of the belt means and a surface of the guide rollers defining said sheet transport path therebetween;

said guide rollers comprising a first set of guide rollers arranged in pairs at axially spaced intervals in the transport path and having their axes of rotation located on a common arc and their surfaces in contact with the belt means, said common arc curved in a direction towards the transport path;

said second set of guide rollers having their axes lying on a chord of the arc between each of the pairs of the first set of guide rollers;

said guide rollers of the second set having smaller diameters than the diameters of the guide rollers of the first set to provide a space between the surfaces of the second set of guide rollers and the lower run of the belt means to accommodate the average thickness of the sheets in transport;

said first set of guide rollers being in surface contact against the lower run of the belt means to provide a slight curvature over a selected circumferential section of the lower run of the belt means for applying frictional force against the sheets in the transport path; and means for driving the belt means and the first set of guide rollers in synchronism.

8. A method of applying frictional force to sheets being transported in a transport path comprising the steps of:

driving an endless belt means having a lower run thereof in contact feeding engagement with sheets being transported in the transport path;

supporting the sheets in transport between the lower run of the belt means and a plurality of rotatable guide means positioned between a first and a second end of the transport path and extending transverse to a direction of the sheet transport;

positioning a first set of said guide means with their axes located on a common arc and having surfaces in contact with the belt means, and positioning a second set of said guide means with their axes spaced further from the belt means and having surfaces out of contact with the belt means; and exerting a radial frictional force against the sheets in transport in response to the first set of guide means acting against the lower run of the belt means to provide a slight curvature over a selected circumferential section of the lower run of the belt means.

9. A method as set forth in claim 8 comprising the further step of driving the first set of guide means in synchronism with the belt means.

10. A method as set forth in claim 9 in which the guide means positioning includes the steps of positioning the guide means of the first set at spaced intervals in the transport path, and positioning the guide means of the second set intermediate the guide means of the first set and with said surfaces of the said second set of guide means spaced from the lower run of the belt means a distance to accomodate therebetween the average thickness of the sheets in transport.

11. A sheet conveyor apparatus for transporting sheets in a longitudinal direction along a transport path, comprising:

a plurality of rotatable guide means positioned in spaced parallel relation and extending transverse to said direction of sheet transport; belt means having a conveying run thereof extending in said sheet transport direction and associated with the rotatable guide means for capturing sheets between the conveying run of the belt means and the surface of the rotatable guide means, said conveying run and the adjacent surfaces of the guide means defining said sheet transport path therebetween; said rotatable guide means including first and second sets of guide means, said first set of guide means having their surfaces positioned relative to one another and in contact with the conveying run of the belt means causing said belt conveying run to have a slight concave curvature in a direction away from said rotatable guide means, and said second set of guide means being intermediate the first set of guide means and having their surfaces spaced slightly from the belt conveying run means.

* * * * *